US005630777A

United States Patent [19]

Garren et al.

[11] Patent Number: 5,630,777

[45] Date of Patent: May 20, 1997

[54] EXERCISE BLOCK

[76] Inventors: Mary L. Garren; Lloyd R. Garren; Melissa Garren; Ross Garren, all of Middle Neck Rd., Warwick, Md. 21912

[21] Appl. No.: 444,042

[22] Filed: May 18, 1995

[51] Int. Cl.[6] ..... A63B 21/02

[52] U.S. Cl. ..... 482/121

[58] Field of Search ..... 482/121, 125, 482/126, 148, 93, 124, 128; 273/25

[56] References Cited

U.S. PATENT DOCUMENTS

| | | | |
|---|---|---|---|
| 4,266,769 | 5/1981 | Hall | 273/25 |
| 4,621,808 | 11/1986 | Orchard et al. | 482/105 |
| 4,756,949 | 7/1988 | Spence et al. | 428/159 |
| 5,011,135 | 4/1991 | Patik | 482/47 |
| 5,242,348 | 9/1993 | Bates | 482/93 X |

*Primary Examiner*—Richard J. Apley
*Assistant Examiner*—Kim M. Lee
*Attorney, Agent, or Firm*—Connolly & Hutz

[57] ABSTRACT

An exercise block comprises a unitary body fabricated from compressible material that returns to its original shape after being compressed. The unitary body has front and rear end walls, opposite side walls, and top and bottom walls. Pairs of spaced apart flexible hand straps are attached to some of the walls for manipulating the block during a wide variety of exercise routines. An inner core also fabricated from compressible material that returns to its original shaped after being compressed is removably associated with the unitary body. Both the unitary body and the inner core each have a particular density whereby the overall compressibility of the exercise block is changeable depending upon the particular density of the inner core, and a plurality of inner cores of varying densities are provided for that purpose.

5 Claims, 2 Drawing Sheets

EXERCISE BLOCK

BACKGROUND OF THE INVENTION

The present invention relates to an exercise block and more particularly to a block that includes a unitary body and interchangeable inner cores that alter the overall density of the block whereby its resistance to compression may be increased or decreased.

Presently, there is a significant emphasis on exercise for the purpose of developing muscle tone, improving health, increasing coordination and dissipating tension. For the most part the current exercise devices consist of weights and spring and pulley mechanisms for use in aerobic and isometric exercises. In many instances the heretofore proposed devices are bulky and cumbersome as well as being difficult to use.

SUMMARY OF THE INVENTION

Accordingly, one of the objects of the present invention is to provide a relatively small light weight exercise block which is easy to use by all age groups.

Another object of the present invention is an exercise block which is simple in construction while being very versatile for a variety of exercise routines.

Basically, the exercise block of the present invention is extremely useful for performing resistance exercises for multiple muscle groups. The exercise block is light weight and fabricated of a compressible material which when deformed will return to its original shape. The resistance to compression of the exercise block can be increased and decreased by inserting cores of material into openings provided for them in the block. The overall shape of the exercise block is designed to help isolate different muscle groups for individual exercise, and in order to facilitate such exercise routines flexible hand straps are placed at critical locations on the device.

Fundamentally, the exercise block of the present invention comprises a unitary body fabricated from compressible material that returns to its original shape after being compressed. The unitary body has front and rear walls, opposite side walls and top and bottom walls. Pairs of spaced apart flexible hand straps are attached to at least some of the walls of the unitary body in order to facilitate a wide variety of exercise routines. An inner core is also fabricated from compressible material that returns to its original shape after being compressed. The inner core is removably connected to the unitary body, and resistance to the compression of the exercise block is changeable depending upon the particular density or compressibility of the inner core.

The exercise block is used in combination with a plurality of inner cores each having a similar shape but each having a different density so that the overall compressibility of the exercise block is changeable depending upon which one of the inner cores is selected and used with the unitary body.

The cores may be cylindrical with insertion into a cylindrical cavity in the unitary body. Alternatively, a rectangular box-shaped core may be used for insertion into a complementary cavity in the body. Moreover, pairs of spaced apart flexible hand straps may be located on each of the walls of the exercise block to facilitate a wide variety of exercise routines.

In a modified embodiment of the present invention the opposite side walls of the unitary body each include a recess extending between the front and rear walls. These recesses are constructed and arranged to accommodate the forearms of the person using the exercise block, and hand straps are located on the side walls to accommodate the forearms and for grasping the exercise block.

BRIEF DESCRIPTION OF THE PATENT DRAWINGS

Novel features and advantages of the present invention in addition to those mentioned above will become apparent to persons skilled in the art from a reading of the following detailed description in conjunction with the accompanying drawing wherein.

DETAILED DESCRIPTION OF THE INVENTION

Figure 1:
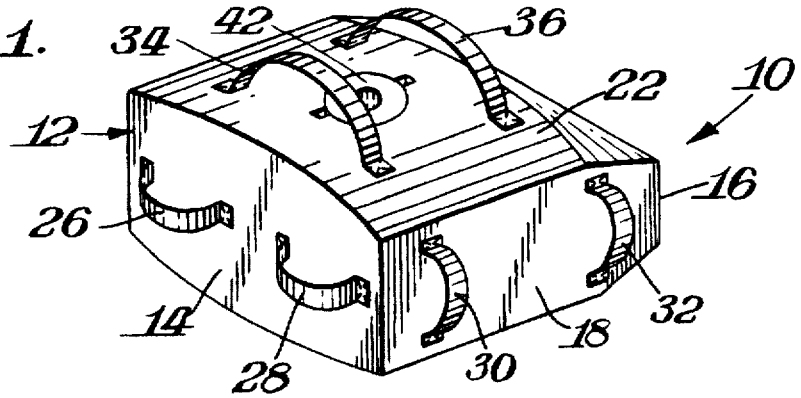
FIG. 1 is a prospective view of an exercise block, according to the present invention.

Referring in more particularity to the drawing, FIGS. 1–5 illustrate an exercise block 10 comprising a unitary body 12 fabricated from compressible material that returns to its original shape after being compressed. Suitable materials include foam rubber, foam plastic, sponge material and similar open cell materials that return to their original shape after being compressed. A wide variety of materials may be utilized, the only criteria being that the material be compressible and possess the capability of returning to its original shape after being compressed.

The unitary body 12 has a front wall 14, a rear wall 16, opposite side walls 18, 20 and top and bottom walls 22 and 24, respectively.

Pairs of spaced apart flexible hand straps are attached to the walls of the unitary body for manipulating the exercise block during a wide variety of exercise routines. These hand straps may be fabricated of any sturdy flexible material such as nylon, for example. Attachment to the unitary body may be accomplished by a variety of procedures such as gluing and/or stitching, for example.

Figure 2:
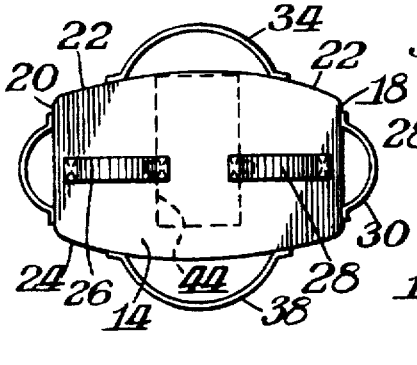
FIG. 2 is a front elevational view of the exercise block shown in FIG. 1.
Figure 3:
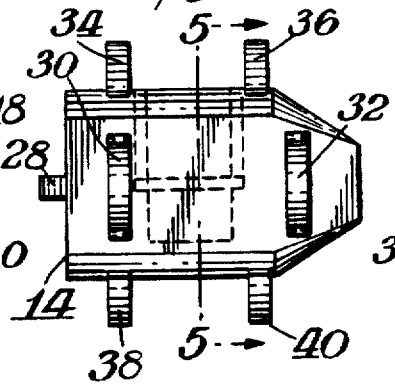
FIG. 3 is a right side elevational view of the exercise block shown in FIG. 1, it being understood that the left side elevational view is a mirror image duplicate.
Figure 4:
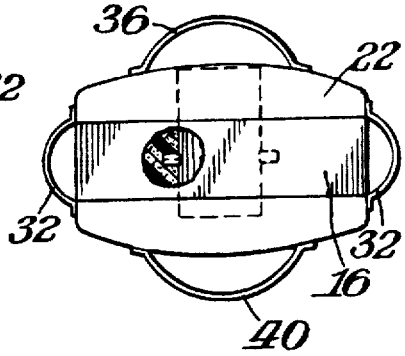
FIG. 4 is an end elevational view of the exercise block shown in FIG. 1.

A pair of flexible hand straps 26, 28 are positioned on the front wall 14, and these straps extend in a side-to-side manner, as shown in FIGS. 1 and 2. Each of the opposite side walls 18, 20 includes a pair of spaced apart hand straps 30, 32 which extend in a top to bottom orientation. The top and bottom walls also include a pair of spaced apart hand straps. The top straps 34, 36 extend in a side-to-side orientation and the bottom wall straps 38, 40 also extend in the same direction.

A inner core 42 also fabricated from compressible material that returns to its original shape after being compressed is removably associated with the unitary body 12. In the exercise block 10 shown in FIGS. 1–5, the removable inner core 42 has a cylindrical shape that matingly fits within a cylindrical cavity 44 extending from the top wall 22 into the unitary body 12. Inner core 42 has a particular density whereby the overall compressibility of the exercise block 10 is changeable depending upon the particular density of the inner core. In most instances, the exercise block is provided in combination with a plurality of similarly shaped inner cores each having a different density so that the overall compressibility of the exercise block is changeable depending upon which one of the inner cores is selected and inserted into the cavity 44 in the unitary body.

Figure 5:
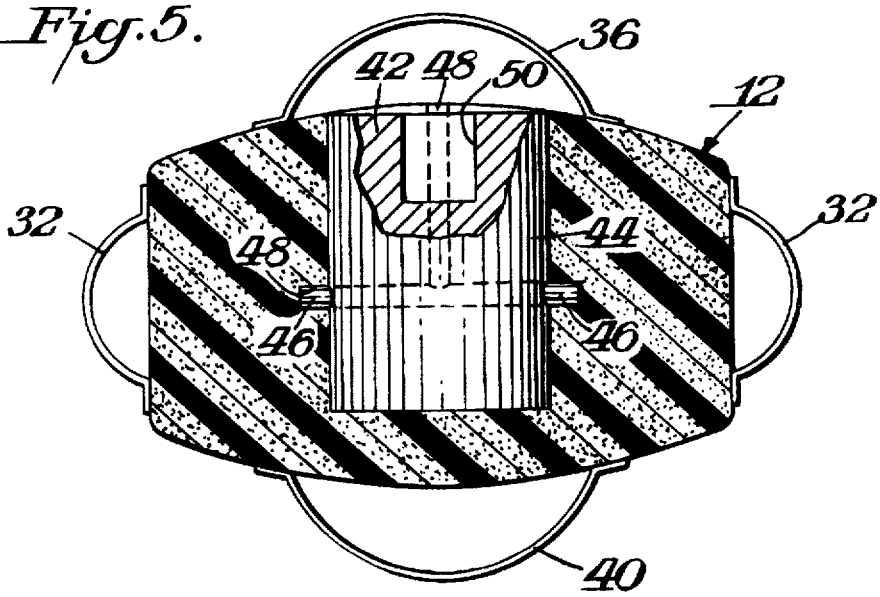
FIG. 5 is a cross-sectional view taken along 5—5 of FIG. 3.

The inner core 42 may include opposite lugs 46 extending outwardly from the cylindrical side wall of the core, as best shown in FIG. 5. A complementary annular slot 48 is provided on the inner wall of the cavity 44 for receiving the lugs 46 in locking engagement when the inner core 42 is positioned in the cavity and rotated. A top finger opening 50 is provided on the inner core to facilitate insertion and removal of the core as well as core rotation for locking and unlocking purposes.

The side walls 18, 20 are generally planar and parallel to one another. Similarly, the front and rear walls 14, 16 are planar and generally parallel to one another. The top and bottom walls 22, 24 interconnect the front, rear and side walls, as shown in FIGS. 1–5, and the top and bottom walls include curved portions as shown. The exercise block 10 is approximately 21" in length by 21" in width. The front wall 14 is about 10" at the sides and 14" high midway between the sides, its thickest dimension. Rear wall 16 is slightly smaller and is generally rectangular in shape about 21" across and 6" high. The rear end of the exercise block has a gradually reduced cross-section which extends from the rear end up to about 7" from the end.

Figure 6:
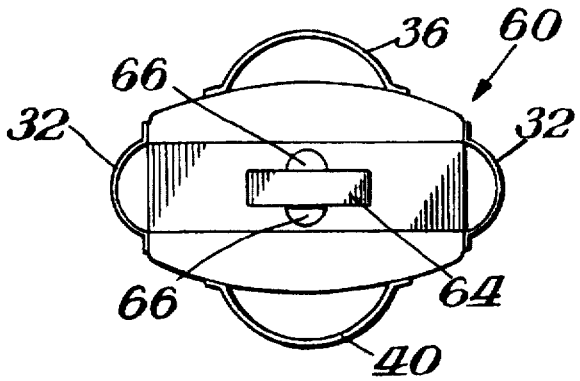
FIG. 6 is an end elevational view of another exercise block, according to the present invention.
Figure 7:
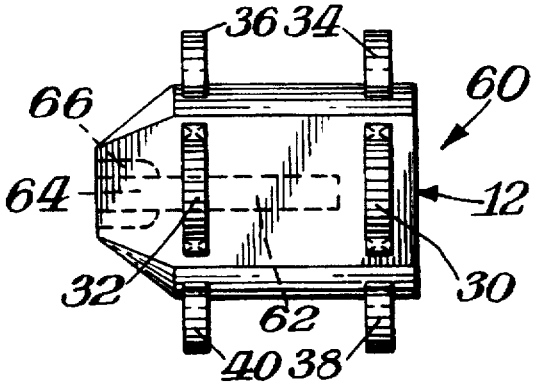
FIG. 7 is a left side elevational view of the exercise block shown in FIG. 6, it being understood that the right side elevational view is a mirror image duplicate.

FIGS. 6 and 7 illustrate another exercise block 60 according to the present invention which is generally similar to exercise block 10 in all respects except the shape and location of the inner core. Exercise block 60 includes inner core 62 having a rectangular box-like shape the inner core. Exercise block 60 includes inner core 62 having a rectangular box-like shape which is inserted and removed from the unitary body through a rectangular shaped opening 64 in end wall 16. Recesses 66 are provided in end wall 16 to facilitate insertion and removal of the inner core 62. Here again, exercise block 60 is used in combination with a plurality of inner cores 62 each having a similar shape but each having a different density. The overall compressibility of the exercise block is changeable depending upon which one of the inner cores is used with the unitary body.

Figure 8:
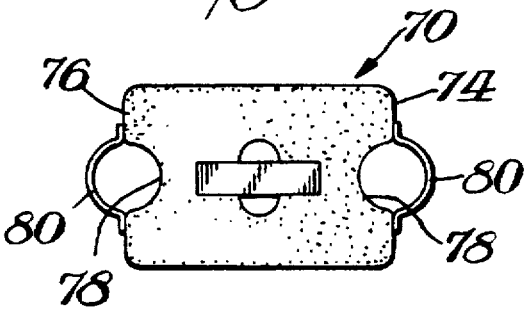
FIG. 8 is a front elevational view of still another exercise block, according to the present invention.
Figure 9:
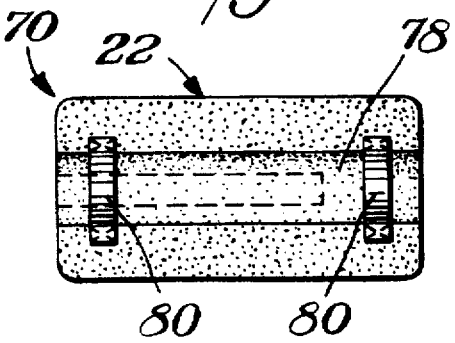
FIG. 9 is a right side elevational view of the exercise block shown in FIG. 8, it being understood that the left side elevational view is a mirror image duplicate.

FIGS. 8 and 9 illustrate another exercise block 70 having a unitary body 72 with a generally rectangular box-like shape. Alternatively, the exercise block 70 may have a unitary body similar to that shown in FIGS. 1–7. Also, the unitary body 72 may include an inner core such as cylindrical core 42 or the rectangular shape of core 64. The opposite side walls 74, 76 of unitary body 72 each include a recess 78 which is constructed and designed to accommodate the forearms of a person using the exercise block 70. Spaced apart flexible hand straps 80, 82 are positioned on each of the side walls 74, 76.

Many exercise routines may be performed with the exercise blocks 10, 60 and 70 of the present invention, and the following routines simple represent a small number of the wide variety that may be performed with these blocks. Upper body exercises for the deltoids and triceps include a two arm block press where the person exercising stands under a door jam with the top wall 22 of the block in contact with the top portion of the jam. Grasping the block by any of the hand straps 38, 40 with the palms facing upward, one or both arms are pushed in an upward direction toward the top of the door jam. These motions may be repeated about 10–12 times.

Another upper body exercise routine is a biceps cuff where the tapered portion 52 of the exercise block adjacent rear wall 16 is positioned between the upper and lower portions of the arm opposite the elbow. Hand strap 34 is then grasped and with constant pressure the hand with the palm up is moved toward the shoulder. The arm may be extended in a lateral or forward direction, and the procedure may be repeated 10–12 times.

Upper body exercise of the pectoralis muscle group includes holding the narrow sides 18, 20 of block 10 or sides 74, 76 of block 70 by the hand straps 30, 32 or 80 and placing the block in front at chest level. The block is then slowly compressed so that each arm is pressed toward the other. The procedure may be repeated 10–12 times.

A triceps extension exercise may be performed while sitting in a chair with the exercise block on a flat area at table height. Either arm is then placed on the top wall 22 with the palm down and the arm bent at the elbow. The arm is pressed in a downward direction toward the floor with constant pressure from the palm to the elbow. The procedure can be repeated 10–12 times, and as an alternative this routine can be performed against a wall while standing.

Exercise of the latissimus dorsl and pectoralis muscle groups may be accomplished with the block against a wall and the person in a standing position elbows bent ninety degrees. The block is grasped by any of the hand straps and pushed toward the wall with constant pressure. The procedure may be repeated 10–12 times.

The lower body exercises include exercise of the thighs by placing the block between the thighs while in a seated position. The block is positioned with the top wall up, the bottom wall down and the tapered end portion toward the crotch. The thighs are pressed together with constant pressure.

Gluteus maximus exercise may be performed with the block on the floor positioned next to a door jam or a wall. In a standing position the heel is placed against the block and the block is compressed toward the door jam for the desired number of repetitions.

Neck exercises are performed by placing the forehead on any surface of the block and pressing in toward the block. This can be repeated with the back of the head and also with the sides of the head. The exercise may be performed with the block located in any position of comfort.

The abdominals may be exercised while sitting in a chair holding the block with the tapered end across the lap. The person simply bends forward the desired number of repetitions.

What is claimed is:

1. An exercise block comprising:

a unitary body fabricated from compressible material that returns to its original shape after being compressed; the unitary body including a front end wall, a rear end wall, opposite side walls a top wall and a bottom wall; pairs of spaced apart flexible hand straps attached to at least some of the walls; and an inner core also fabricated from compressible material that returns to its original shape after being compressed removably associated with the unitary body, both the unitary body and the removable inner core each having a different density, and at least one additional inner core having a similar shape but having a different density from the other inner core whereby the overall compressibility of the exercise block is changeable depending upon which one of the inner cores is associated with the unitary body.

2. An exercise block as in claim 1 wherein pairs of spaced apart hand straps are attached to the front, top, bottom and opposite side walls of the unitary body, the opposite side walls of the unitary body each including a recess extending between the front and rear walls, and wherein each side wall is constructed and arranged to accomodater the forearms of a person using the exercise block.

3. An exercise block comprising: a unitary body fabricated from compressible material that returns to its original shape after being compressed; the unitary body including a front end wall, a rear end wall, opposite side walls, a top wall and a bottom wall; pairs of spaced apart flexible hand straps attached to at least some of the walls; and an inner core also fabricated from compressible material that returns to its original shape after being compressed removably associated with the unitary body, both the unitary body and the removable inner core each having a different density, and locking means for releasably connecting the inner core to the unitary body, and wherein the locking means includes at least one lug on the outside of the inner core and a cooperating slot on the unitary body into which the lug is positioned.

4. An exercise block comprising: a unitary body fabricated from compressible material that returns to its original shape after being compressed; the unitary body including a front end wall, a rear end wall, opposite side walls, a top wall and a bottom wall; pairs of spaced apart flexible hand straps attached to at least some of the walls; and an inner core also fabricated from compressible material that returns to its original shape after being compressed removably associated with the unitary body, both the unitary body and the removable inner core each having a different density, and the opposite side walls of unitary body each including a recess extending between the front and rear walls, and wherein each side wall recess is constructed and arranged to accommodate the forearms of a person using the exercise block.

5. An exercise block as in claim 4 wherein each side wall includes a pair of spaced apart flexible hand straps.

* * * * *

UNITED STATES PATENT AND TRADEMARK OFFICE

CERTIFICATE OF CORRECTION

PATENT NO. : 5,630,777
DATED : May 20, 1997
INVENTOR(S) : Mary L. Garren, et al.

It is certified that error appears in the above-indentified patent and that said Letters Patent is hereby corrected as shown below:

Column 4, line 10, "cuff" should read -- curl --.

Column 5, line 9 (claim 1, last line), after "body" insert --,the opposite side walls of the unitary body each including a recess extending between the front and rear walls, and wherein each side wall is constructed and arranged to accomodate the forearms of a person using the exercise block -- ; and line 12 (claim 2, line 3), delete "the opposite side walls of the unitary body each including a recess extending between the front and rear walls, and wherein each side wall is constructed and arranged to accomodate the forearms of a person using the exercise block", insert a period.

Signed and Sealed this
Twenty-sixth Day of August, 1997

*Attest:*

*Attesting Officer*

Bruce Lehman

BRUCE LEHMAN

*Commissioner of Patents and Trademarks*